United States Patent [19]

Holford

[11] Patent Number: 5,044,107

[45] Date of Patent: Sep. 3, 1991

[54] TALKING RIFLE

[75] Inventor: John E. Holford, Fredericksburg, Va.

[73] Assignee: The United States of America as represented by the Secretary of the Army, Washington, D.C.

[21] Appl. No.: 571,064

[22] Filed: Aug. 23, 1990

[51] Int. Cl.[5] ..... F41G 1/38

[52] U.S. Cl. ..... 42/103; 42/71.01; 42/106

[58] Field of Search ..... 42/1.01, 71.01, 103, 42/106; 244/3.11, 3.13, 3.14

[56] References Cited

U.S. PATENT DOCUMENTS 2,990,471 6/1961 Tiffany .
3,400,393 9/1968 Ash .
3,898,747 8/1975 Marshall .
4,008,478 2/1977 Ikrath et al. .
4,281,993 8/1981 Shaw .
4,471,683 9/1984 Brown .
4,936,037 6/1990 Holcomb et al. .

*Primary Examiner*—Richard W. Wendtland
*Attorney, Agent, or Firm*—Milton W. Lee; John E. Holford; Anthony T. Lane

[57] ABSTRACT

The invention provides an individual radio communicator which is integrated with a weapon such that the communicator is part of a rifle stock or its equivalent and the weapon barrel becomes an antenna and/or an aiming light on the weapon becomes an optical channel for convert radio transmission.

20 Claims, 3 Drawing Sheets

TALKING RIFLE

The invention described herein may be manufactured, used, and licensed by the U.S. Government for governmental purposes without the payment of any royalties thereon.

BACKGROUND OF INVENTION

1. Field

The invention relates to a combined radio and weapon, particularly an individual soldier's rifle.

2. Background

The improvements in small two-way radios now make it possible for each individual soldier to have his own radio communicator. This does, however, pose certain problems. When used as a receiver the unit is most valuable in disseminating tactical data and specific orders, but when used as a transmitter it can render the user vulnerable to enemy action. In critical situations the use of a radio also tends to engage one or more of the users hands, which are needed to control a weapon. Further under the stress of battlefield situations such equipment tends to get lost, broken or even intentionally discarded. A large part of a soldiers basic training deals with the maintenance and care of his rifle. An object of the present invention is to extend this training benefit to his radio by making it an integral part of his rifle or other weapon. At the same time it is an object to use parts of the weapon, without inhibiting their normal function to improve the performance of the radio.

BRIEF DESCRIPTION OF THE INVENTION

The invention extends the utility of an individual soldier's rifle or equivalent weapon, by making it into a two way communication radio. The radio is mounted into the gun stock. For radio frequency transmissions the gun barrel serves as an antenna for the radio. For covert communications a weapon with an aiming light is used. The aiming light is provided with an optical modulator and/or a demodulator. When connected to the radio, the modified aiming light provides an optical carrier for diverse covert communications and target identification in addition to the normal advantages of the aiming light.

BRIEF DESCRIPTION OF THE DRAWINGS

The invention is best understood with reference to the attached drawings wherein.

DESCRIPTION OF THE PREFERRED EMBODIMENT

Figure 1:
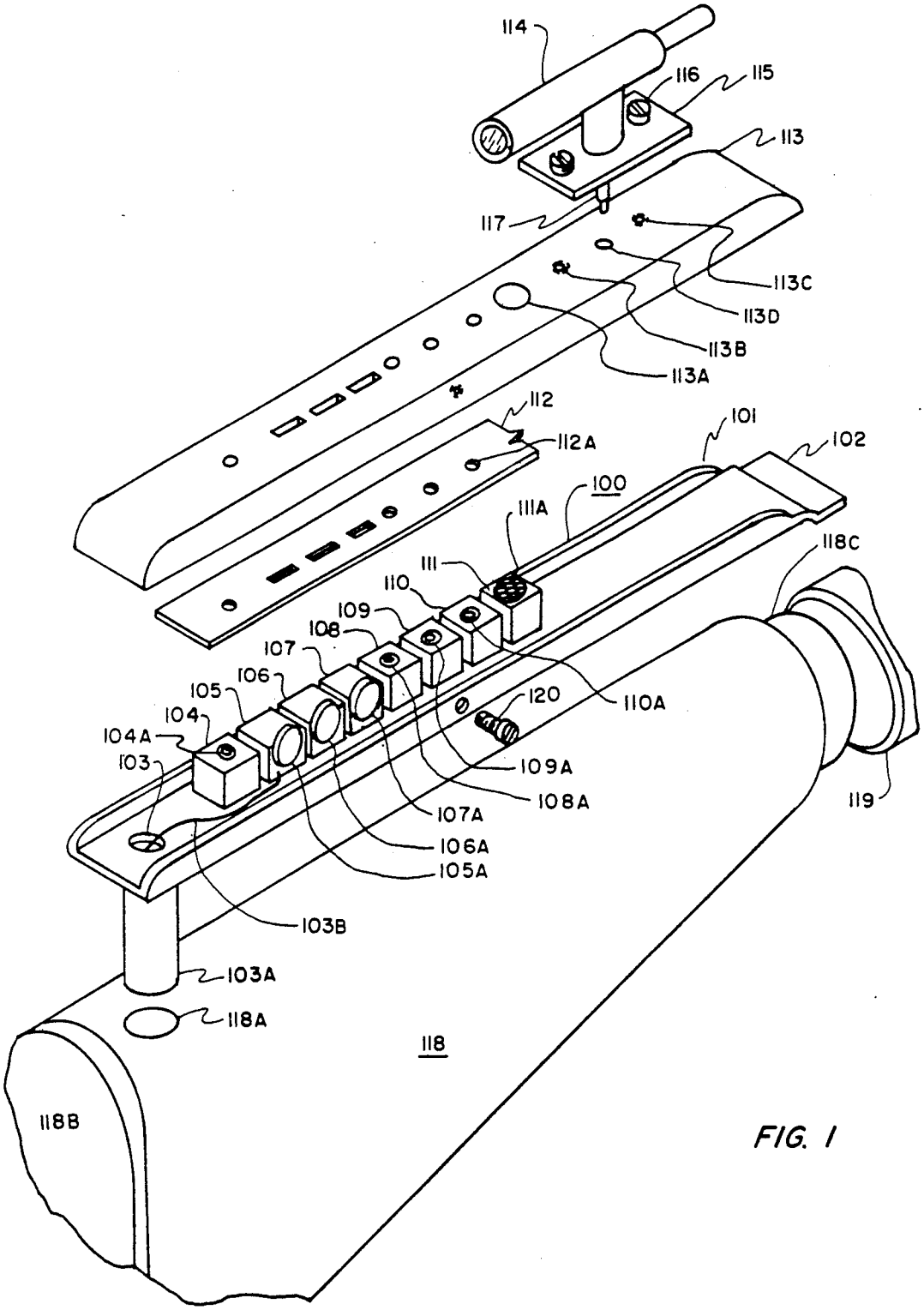
FIG. 1 shows an embodiment of a rifle mounted radio communicator according to the present invention.

As shown in FIG. 1, the preferred configuration of a rifle mounted radio is long and bar-like as prescribed by the base channel housing member 100. The channel member is mounted with its side legs 101 upward, to enclose the requisite electronic modules like modules

105–111 and any discrete elements in the radio. The channel member has a stepped tab 102 on one end and a cylindrical hole 103 at its opposite end large enough to admit a commercially available cylindrical long life alkaline battery. A cylindrical battery case 103A, with one closed end, is attached to the channel at its open end and extends normally downward to form a coaxial extension of the cylindrical hole 103 long enough to contain one or more batteries. The batteries are wired through the hole 103 to at least one electronic element, such as the switch module 105. The switch module may also have an exposed jack (not shown), to connect to an external power source to conserve or recharge the batteries. Other of the modules also include similar exposed elements, which provide additional external inputs and outputs. Module 104 may include a microphone 104A, a jack for an external microphone or both. Modules 105–107 may have thumb wheels 105A–107A for external switching, volume control and tuning, respectively. Modules 108–110 may include jacks 108A–110A for auxiliary audio or RF inputs and outputs. Module 111 may contain a miniature loud-speaker 111A. Discrete elements such as capacitors, dropping resistors and tuning crystals can be fitted around and between the modules. The modules will usually contain integrated circuits, small transistors, etc. To insulate terminals on the modules from the housing, strips of insulation 112 with holes like 112A, to access exposed elements 104A–110A, may be employed. The housing is completed by a cover 113, shaped to fit tightly over channel 100. The cover also has holes like hole 113A to match the jacks, thumb-wheels and the like of the modules. The holes in the cover are slightly larger than those in the strip 112, so that the cover will not touch the exposed elements or plug terminals inserted into them. The use of strip 112 and others like it assume that housing members 100 and 113 are metal. If they are plastic, the tab 102 will be metal-covered and wired to the radio's antenna terminal, preferably with an insulated wire. The battery case 103A preferably is metal lined with plastic, for strength and obvious electrical and chemical advantages, but cost factors may restrict it to only one of these materials. The cover may also have holes to mount an aiming light 114. An aiming light is a source of a highly collimated light beam that is boresighted with a rifle or other weapon to indicate the path of the missile fired. The light may be visible or invisible, such as infrared; the latter requires the use of infrared goggles or the like. Convenient light sources are light emitting diodes and laser diodes. The cover mounted aiming light is provided with an inverted T-shaped base 115 through which screws 116 are threaded into the cover. A cable 117 is threaded through the stem of the base and cover 113 to provide DC, if necessary, and two-way audio communication between the radio and the aiming light. Otherwise the aiming light is mounted on a standard sight mounting and is supplied with a cable that plugs into modules like 109 and 110.

To mount the radio on a rifle stock 118, a hole large enough to snugly fit the battery case 103A is drilled in the top of the stock near the shoulder rest 118B. The tab 102 on the housing is formed to follow the contour of the adjacent end of the gunstock, which may have a protrusion 118C, as shown, or a recess. When the mating metal portion 119 of the weapon is installed, the radio is mechanically and electrically connected to the metal portion which includes the breech, the barrel and usually a cartridge magazine. Together these elements provide a more rugged and reliable RF antenna than is normally found in this type of radio.

Figure 2:
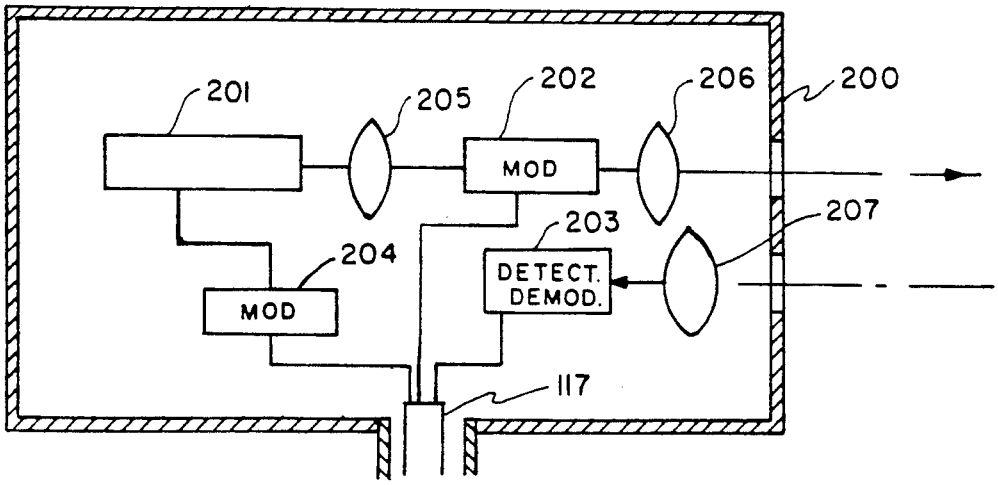
FIG. 2 shows a block diagram of a modified aiming light according to the present invention.

FIG. 2 shows a modified aiming light which has special utility, when used with the radio described above. In addition to the usual housing 200, light source 201 and beam forming optic element 205, when needed; the aiming light is provided with an electro-optical modulator. Electro-optical modulators and demodulators are described in ELECTRONICS ENGINEER'S Handbook, 2nd ed. Copyright 1982. The modulator can vary the amplitude, phase or frequency of the light beam with an electro-optical element 202; or simply vary the electrical supply to light source 201 with an electronic modulator 204 or both. The electronic type modulator 204 can be placed in the radio, but if the aiming light has its own power supply, it may have more capacity than the radio. The modulator uses the light beam of the aiming light to carry the audio from the two-way radio, so that in addition to its normal sighting function it can identify the user to a distant target or deliver an audible message, if the target has an optical demodulator.

Figure 2A:
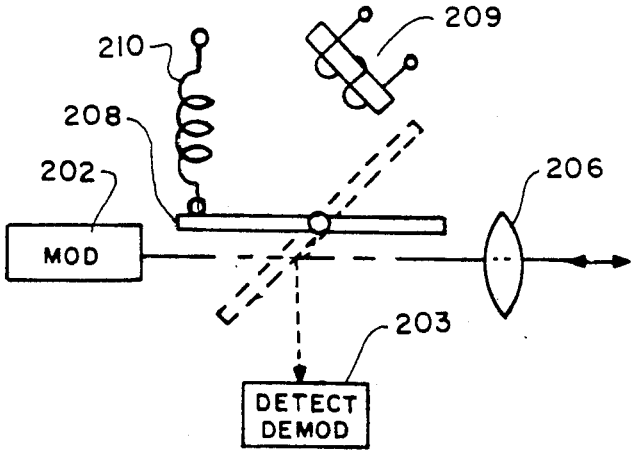
FIG. 2*a* shows a possible further modification of the aiming light in FIG. 2.

A further or alternate variation of the aiming light is the addition of an optical detector and demodulator 203. This element may have its own light gathering optic element 207 or share element 206, if present. As shown in FIG. 2*a*, this may require a manual or electrically deflected mirror 208 activated by solenoid 209 along with the modulator or demodulator, preferably the latter so that spring 210 can bias the mirror and restore the aiming light function in the absence of an electrical demodulation power signal.

Figure 3:
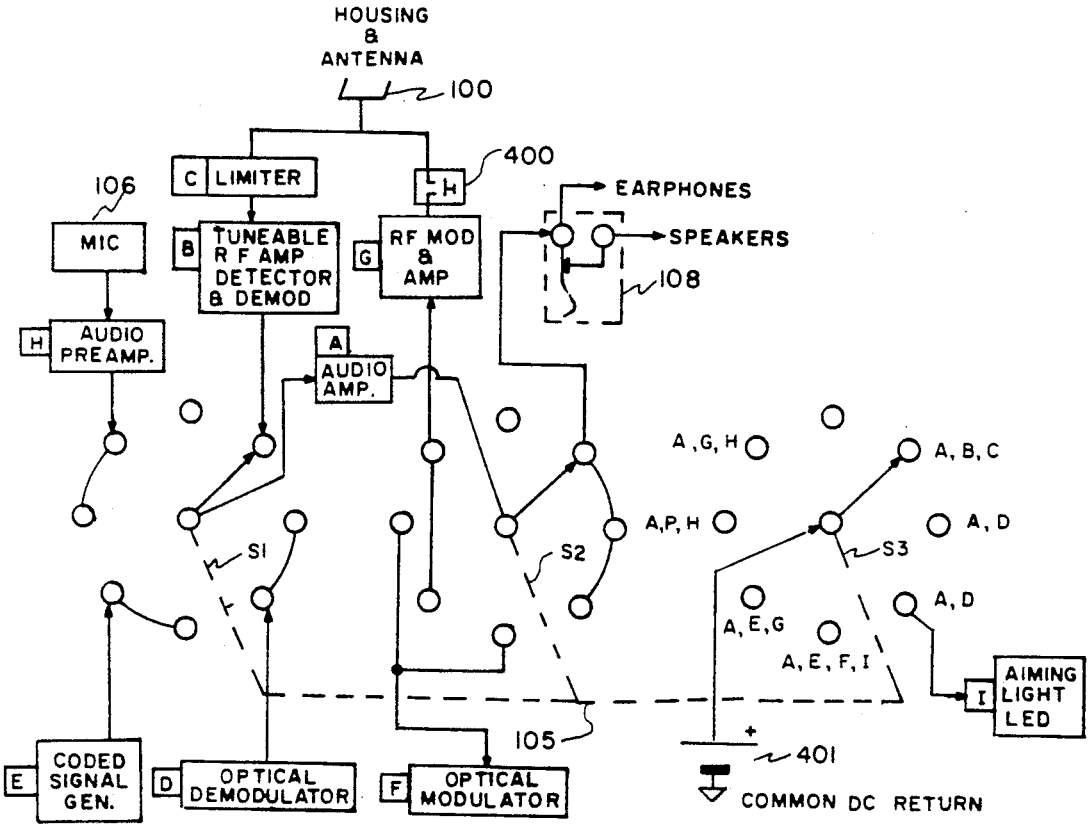
FIG. 3 shows a block diagram of a two-way radio according to the present invention.

FIG. 3 shows a block diagram of the radio to better understand its relation to the modified aiming light. Radio frequency (RF) input and output for the radio is through the housing and antenna 100 as described in FIG. 1. The diverse functions of the radio are controlled by the switch module 105, also in FIG. 1, which may, for example, contain a three pole eight throw switch. The first and second poles S1 and S2 are connected to the input and output respectively of an audio amplifier A. Beginning with the uppermost throw terminal on S1 and moving clockwise the input to the audio amplifier can first be switched from no input in an off position to the output of a tuneable RF demodulator B. The volume of the audio amplifier is controlled by a thumb wheel such as wheel 106A in FIG. 1 and the input frequency to the demodulator by wheel 107A in FIG. 1. Pole S2 connects the audio output through disconnect jack 108 to the speaker 111 in FIG. 1. When an earphone plug is inserted in jack 108, the speaker is disconnected for covert use close to enemy ears. The output is similarly connected for the second and third throw terminal positions while S1 supplies an audio input from the optical demodulator F or element 203 in FIG. 2. To conserve battery power and avoid cross-talk, pole S3 supplies direct battery current only to those elements in use at the same time. Hence the first throw after the off position connects elements A, B, and C, the audio amplifier, the RF demodulation and the limiter; etc. Note that in the third throw position the aiming light is on with the optical demodulator and the arrangement in FIG. 2, not FIG. 2*a* must be used when this option is provided. The last four throws shift the radio function from reception to transmission. Pole S2 alternates the output between the optical modulator F and the RF modulator and amplifier G. Since the RF modulator and demodulator are usually not used at the same time, the same thumb-wheel 107A can be used to tune both, preferably to the same frequency. Pole S1 meanwhile supplies two different audio inputs for each type of modulator. The first is a coded signal input from generator E which serves to identify the source of the aiming light, e.g. in an identification friend or foe (IFF) situation. It also permits the user to identify a reflection of his own aiming light from other stray reflections. The second audio input comes from the microphone and preamplifier H providing two completely different channels of voice communication. It is also possible to combine both the coded signal generator and the preamplifier outputs by connecting the fifth and sixth terminals of S1 and energizing either or both from the fourth to eighth terminals of S3.

Two other elements that may be desireable are the limiter C, activated by the first throw of pole S3, and the normally-open momentary switch 400. The limiter prevents high-power signals from the RF transmitter G from damaging the sensitive detector in the RF receiver B. There are many commercially available limiters which use electrical breakdown of materials or the nonreciprocal transmission properties of ferrites to achieve this goal. The momentary switch provides a security measure to avoid inadvertant radiation of RF energy. In certain military field scenarios such radiations could greatly endanger not only the user, but perhaps an entire operation and the men and equipment involved.

In situations where a number of audible transmissions occur simultaneously or the electro-optical devices work better at RF frequencies, the audio signals can be used to modulate RF carriers and these used to modulate the aiming light, of course the output of the optical demodulator must then include an RF demodulator to produce an audio output.

Figure 4:
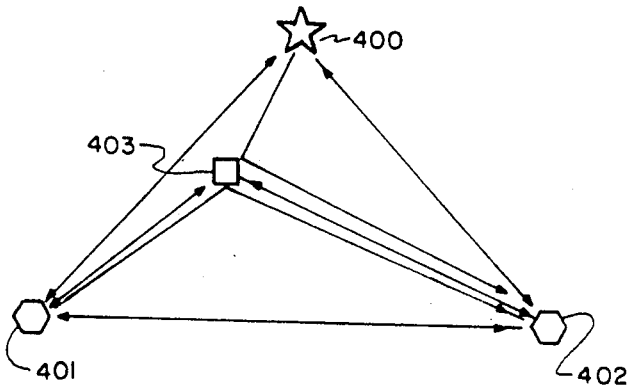
FIG. 4 shows a battlefield scenario demonstrating various methods of using the radio and aiming light of FIGS. 1–4.

FIG. 4 shows a typical military field situation in which the weapon according to the present invention may be employed. In general, there will be a command location 400 from which the military operation is controlled. If this point is suitably fortified, it may freely transmit RF instructions to field units or individual soldiers such as units 401 and 402. Similarly units 401 and 402 may communicate with location 400 or one another using RF transmission, if the circumstances are not critical. Otherwise any or all transmissions can be made between these locations using an aiming light beam as a carrier. The coded signal generator can be used to identify the source of the transmissions, if any doubt exists.

When the weapon is used in the normal aiming light mode by unit 401, for example, to sight on an enemy target 403 the coded signal generated can indicate this information to unit 402. The latter may be in a better position fire on this target, either because he is safer or has more fire-power. For example, the target may be tank and unit 402 may have a bazooka while unit 401 who may be much closer has only a rifle. If the optical modulators and demodulators employ frequency modulation, it is possible to identify certain targets by the audible signatures their vibrations impress on the reflected aiming light beam. This is one reason the optical demodulator is activated with the aiming light in FIG. 3. In addition unit 402 may use the information provided by the coded signal generator and voice communication from 401 to more effectively deal with the target. Of course the invention can also be used for simple morale purposes to listen to music or entertainment broadcasts from unit 400, for example.

Although the inclusion of all the options described above is most attractive, it should be noted that the invention also acknowledges the advantages of having only an RF receiver, an RF transmitter, an optical receiver or an optical transmitter with no more than a single press-to-use button.

I claim:

1. An aiming light for a weapon used in conjunction with a communication radio having an input and an output terminal for audio modulated electrical signals comprising:

an aiming light housing;

a source of highly collimated light photons mounted in said housing;

a first electro-optical means within said housing to couple audio signals between said photons and electron carriers passing through at least one of said terminals; and means to mount said aiming light housing on said weapon.

2. An aiming light as set forth in claim 1 wherein:

said first means is an electro-optical modulator to couple audio signals from said output terminal to said photons.

3. An aiming light as set forth in claim 1 wherein:

said first means is an electro-optical modulator to couple audio signals from said photons to said input terminal.

4. An aiming light as set forth in claim 2 further including:

an electro-optical demodulator means mounted in said housing to couple audio signals from said collimated light photons after they are reflected from a distant target as well as other light photons reflected or emitted from said target.

5. An aiming light according to claim 1, wherein:

said means to mount said aiming light is said radio with at least one of its input and output terminals electrically connected to said first means.

6. An aiming light according to claim 2, wherein:

said means to mount said aiming light is said radio with its output electrically connected to said first means.

7. An aiming light according to claim 3, wherein:

said means to mount said aiming light is said radio with its input electrically connected to said first means.

8. An aiming light according to claim 4, wherein:

said means to mount said aiming light is said radio with its input electrically connected to said demodulator and its output connected to said modulator.

9. An aiming light according to claim 6, wherein:

said radio has a metal surface portion positioned to contact a metal portion of said weapon such that said metal portion will provide an antenna for said radio.

10. An aiming light according to claim 7, wherein:

said radio has a metal surface portion positioned to contact a metal portion of said weapon such that said metal portion will provide an antenna for said radio.

11. An aiming light according to claim 8, wherein:

said radio has a metal surface portion positioned to contact a metal portion of said weapon such that said metal portion will provide an antenna for said radio.

12. A handheld weapon for an individual user having a long, narrow and relatively flat top surface portion; a sighted launching means to accurately direct a missile from the weapon to a distant target and a radio mechanically and electrically interconnected with said means wherein:

said radio is enclosed in a long, thin, bar-like housing having an external metal antenna terminal tab, broad upper and lower surfaces; and with components controlled by said user, chosen from a group comprising sound transducers, mode switches, volume controls, tuning controls and jacks for external devices, all being accessible through openings in said upper surface of said housing, said lower surface of said housing being in contact with said top surface portion of said weapon and secured thereto at remote ends of said housing, whereby the shape of the weapon is changed as little as possible; and said sighted launching means is a transducing means for coupling audio frequency modulated carrier waves between said radio and free space.

13. The weapon according to claim 12, wherein said sighted launching means includes:

an elongated metal portion directly contacting said metal tab of said bar-like housing and defining a gun barrel which also forms an antenna for said radio.

14. The weapon according to claim 12, wherein said radio is a two way radio with an output terminal for audio modulated electrical signals and said sighted launching means includes:

an aiming light source with an electro-optical modulation means coupled between said output terminal of said radio and said light source to modulate the light from said source with information signals generated by said radio.

15. The weapon according to claim 12, wherein said radio includes an input terminal for audio modulated electrical signals and said sighted launching means includes:

an aiming light source with an optical-electric demodulation means coupled to said input terminal of said radio whereby modulated light emitted or reflected by said target can be detected and identified by said radio.

16. The weapon according to claim 15, wherein said radio includes an output terminal for audio modulated electrical signals and said aiming light source further includes:

an electro-optical modulation means coupled between said output of said radio and said light source whereby said radio can detect its own characteristic sounds from said reflected light as well as those of the target.

17. The weapon according to claim 13, wherein said radio is a two way radio having an input and an output terminal for audio modulated electrical signals and said sighted launching means includes:

an aiming light source with an electro-optical modulation means coupled between said output terminal of said radio and said light source to modulate the light from said source with signals generated by said radio.

18. The weapon according to claim 13, wherein said radio has an input and an output terminal for audio modulated electrical signals and said sighted launching means includes:

an aiming light source with an optical-electric demodulation means coupled to said input terminal of said radio whereby modulated light emitted or reflected by said target can be detected by said radio.

19. The weapon according to claim 18, wherein said radio has an input and an output terminal for audio modulated electrical signals and said aiming light source further includes:

an electro-optical modulation means coupled between said output terminal of said radio and said light source whereby said radio can detect its own characteristic modulations as well as those of the target.

20. In combination:

a rifle having at least a metal barrel and a metal breech as portions thereof;

a radio mounted on said rifle;

an aiming light sight mounted on said rifle said light sight including a collimated light source with a separate enabling DC power input defining an optical direct path to a distant target and an optical return path for light reflected from said target to said sight;

an electronic output device with a separate enabling DC power input comprising a light modulator mounted in said sight in said direct path;

an electronic input device with a separate enabling DC power input comprising a light demodulator mounted in said sight in said return path;

said radio including;

a three pole switch having multiple throw terminals on each pole;

an audio amplifier with an input connected to a first of said poles and an output connected to a second of said poles;

a DC source connected to a third of said poles;

input devices comprising a microphone, a coded signal generator, and an RF receiver, directly electrically connected by a limiter to the metal portions of said rifle as an antenna each of said input devices having a separate enabling DC power input;

output devices comprising a loud speaker, earphones and an audio modulated RF amplifier with a separate enabling DC power input connected to the metal portions of said rifle as an antenna;

said input devices each having a signal output for audio modulated electrical signals;

said output devices each having a signal input for audio modulated electrical signals;

said signal outputs of said input devices being connected to different ones of the throw terminals on said first pole;

said signal inputs of said output devices being connected to different ones of the throw terminals on said second pole, whereby each throw position provides a different combination of input and output devices;

the enabling power inputs to both input and output devices and said aiming light being connected to different ones of the throw terminals on said third pole so as to energize the devices desired at each throw position; and the throw terminals at one switch position having no devices connected to define an "OFF" position.

* * * * *